US010044155B1

(12) United States Patent
Newman et al.

(10) Patent No.: US 10,044,155 B1
(45) Date of Patent: Aug. 7, 2018

(54) CONNECTOR FOR CONNECTING A DEVICE TO A PLURALITY OF PADS ARRANGED AT DIFFERENT RADIAL DISTANCES FROM THE SOURCE

(71) Applicant: QUALCOMM Incorporated, San Diego, CA (US)

(72) Inventors: Brent William Newman, Carlsbad, CA (US); James Blair, Ramona, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/591,109

(22) Filed: May 10, 2017

(51) Int. Cl.

| | |
|---|---|
| ***H01R 24/00*** | (2011.01) |
| ***H01R 24/86*** | (2011.01) |
| ***H01R 24/40*** | (2011.01) |
| ***H01R 24/38*** | (2011.01) |
| *H01R 107/00* | (2006.01) |

(52) U.S. Cl.
CPC ..... *H01R 24/86* (2013.01); *H01R 24/38* (2013.01); *H01R 24/40* (2013.01); *H01R 2107/00* (2013.01)

(58) Field of Classification Search
CPC ..... H01R 23/02; H01R 24/00; H01R 24/38; H01R 24/40; H01R 24/60; H01R 24/62; H01R 24/86; H01R 33/00
USPC ..... 439/660
See application file for complete search history.

(56) References Cited

U.S. PATENT DOCUMENTS

| | | | | |
|---|---|---|---|---|
| 5,190,472 | A | 3/1993 | Voltz et al. | |
| 5,757,878 | A * | 5/1998 | Dobbs | A61B 6/032 378/19 |
| 5,846,094 | A * | 12/1998 | Murray | H04M 1/02 439/493 |
| 6,139,337 | A * | 10/2000 | Englert | A61B 6/035 439/66 |
| 6,468,089 | B1 | 10/2002 | Hubbard et al. | |
| 7,029,302 | B2 * | 4/2006 | Sawaya | A61B 6/032 439/260 |
| 7,579,848 | B2 | 8/2009 | Bottoms et al. | |
| 7,792,239 | B2 * | 9/2010 | Nambu | A61B 6/032 378/19 |
| 8,360,805 | B2 | 1/2013 | Schwarz | |
| 9,788,804 | B2 * | 10/2017 | Bailey | A61B 6/032 |
| 2008/0100330 | A1 | 5/2008 | Ito et al. | |

* cited by examiner

*Primary Examiner* — Chandrika Prasad
(74) *Attorney, Agent, or Firm* — MG-IP Law, P.C.

(57) ABSTRACT

A radial quarter-round shaped multi-signal connector according to some examples may allow for a trace length that is much easier to maintain the minimal routing due to a near constant radius of the connector. The radial quarter-round shaped connector may also allow the layout artist much more freedom on placement, while maintaining solid signal integrity, signal symmetry, and a short reach, with no or minimal serpentine traces.

27 Claims, 10 Drawing Sheets

PRIOR
ART

PRIOR
ART

CONNECTOR FOR CONNECTING A DEVICE TO A PLURALITY OF PADS ARRANGED AT DIFFERENT RADIAL DISTANCES FROM THE SOURCE

FIELD OF DISCLOSURE

This disclosure relates generally to connectors, and more specifically, but not exclusively, to connector for differential routing.

BACKGROUND

Differential signaling is a method for electrically transmitting information using two complementary signals. The technique sends the same electrical signal as a differential pair of signals, each in its own conductor. The pair of conductors can be wires (typically twisted together) or traces on a circuit board. The receiving circuit responds to the electrical difference between the two signals, rather than the difference between a single wire and ground. The opposite technique is called single-ended signaling. Differential pairs are usually found on printed circuit boards, in twisted-pair and ribbon cables, and in connectors. The electronics industry, particularly in portable and mobile devices, continually strives to lower supply voltage to save power and reduce emitted electromagnetic radiation. A low supply voltage, however, reduces noise immunity. Differential signaling helps to reduce these problems because, for a given supply voltage, it provides twice the noise immunity of a single-ended system.

Routing high-speed (>1.0 Gbps), high density differential signals out of small pitch (distance from pin to pin), BGA (Ball Grid Array) from an SoC (System On a Chip) to a traditional linear single or multi-row connector is extremely difficult to achieve while maintaining positive transmission line effects. Some of the things that help maintain positive transmission line effects are short trace lengths that must be distance and phase matched, to achieve signal symmetry. Differential routing for multi-lane interfaces dictates that all trace lengths must match the longest signal trace. Not only does a differential pair match, but all lane pairs that are part of the defined interface. Reach is the maximum distance that a signal can safely travel through a particular medium without degradation. Due to challenging layout trade-offs, this may force a conflict with a design specification's reach requirements. Traditional rectangular multi-signal linear connectors take so much space that they block other routing that needs to be routed out of the SoC's BGA field. Traditional linear connectors tend to create longer trace lengths, or push-out from the BGA field due to right angle triangle hypotenuse to base length differences. Consider right triangle geometry: The base of the right triangle is the shortest distance from pin (or ball from a BGA) to the traditional linear connector—distance "b" in FIG. 1. The hypotenuse is the longest distance from the SoC to connector end connections of the connector—distance "c" in FIG. 1. The longest distance always determines the minimum differential routing. Shorter base distances create huge problems for routing due to the need for aggressive trace elongation to match the hypotenuse trace length. This trace elongation in confined space appears in two forms: serpentine and trombone trace type configurations as shown in FIG. 2. Serpentine trace configurations look like a, "snake in the sand", while the trombone traces look similar to the bends in the musical instrument from the mouthpiece to the bell, which have two long 180 degree bends. This exacerbates the problem of routing other signals out. Thus, the connector is "pushed-out" farther away from the BGA field as a trade-off in support of routing other signals as well as meeting matched length requirements of differential signals.

A new connector type needs to be implemented to overcome the significant challenges of routing many high channel count HSIO's (High-Speed Input/Output) out of a SoC's package. These could also be used in small geometric areas without degrading the HSIO signals, while allowing other signals to be safely routed out. Accordingly, there is a need for systems, apparatus, and methods that overcome the deficiencies of conventional approaches including the methods, system and apparatus provided hereby.

SUMMARY

The following presents a simplified summary relating to one or more aspects and/or examples associated with the apparatus and methods disclosed herein. As such, the following summary should not be considered an extensive overview relating to all contemplated aspects and/or examples, nor should the following summary be regarded to identify key or critical elements relating to all contemplated aspects and/or examples or to delineate the scope associated with any particular aspect and/or example. Accordingly, the following summary has the sole purpose to present certain concepts relating to one or more aspects and/or examples relating to the apparatus and methods disclosed herein in a simplified form to precede the detailed description presented below.

In one aspect, a cable connector comprise: a connector body with an inner radius and an outer radius longer than the inner radius; a first plurality of connector pads disposed at a first radius on the connector body, each of the first plurality of connector pads disposed along a radial axis different from each other; a first plurality of conductive traces configured to connect the first plurality of connector pads to a device, wherein each of the first plurality of conductive traces has substantially a first length; a second plurality of connector pads disposed at a second radius greater than the first radius on the connector body, each of the second plurality of connector pads disposed along a radial axis different from each other and each of the radial axis of the first plurality of connector pads; and a second plurality of conductive traces different from the first plurality of conductive traces and configured to connect the second plurality of connector pads to the device, wherein each of the second plurality of conductive traces has a second length equal to the first length.

In another aspect, a cable connector comprises: a connector body with an inner radius and an outer radius longer than the inner radius; a plurality of connector pads disposed at a first radius, each of the plurality of connector pads disposed along a radial axis different from each other; a plurality of conductive traces configured to connect the first plurality of connector pads to a device, wherein each of the first plurality of conductive traces has substantially a first length; and wherein a first signal on one of the plurality of conductive traces has a signal symmetry with a second signal on a different one of the plurality of conductive traces.

In still another aspect, a cable connector comprises: a connector body with an inner radius, an outer radius longer than the inner radius, a first surface, and a second surface opposite the first surface; a first plurality of connector pads disposed at a first radius on the first surface of the connector body, each of the first plurality of connector pads disposed along a radial axis different from each other; a first plurality of conductive traces configured to connect the first plurality of connector pads to a device, wherein each of the first plurality of conductive traces has substantially a first length; a second plurality of connector pads disposed at a second radius greater than the first radius on the first surface of the connector body, each of the second plurality of connector pads disposed along a radial axis different from each other and each of the radial axis of the first plurality of connector pads; a second plurality of conductive traces different from the first plurality of conductive traces and configured to connect the second plurality of connector pads to the device, wherein each of the second plurality of conductive traces has a second length equal to the first length; a third plurality of connector pads disposed at the first radius on the second surface of the connector body, each of the third plurality of connector pads disposed along a radial axis different from each other; a third plurality of conductive traces configured to connect the third plurality of connector pads to the device, wherein each of the third plurality of conductive traces has substantially a third length; a fourth plurality of connector pads disposed at the second radius greater than the first radius on the second surface of the connector body, each of the fourth plurality of connector pads disposed along a radial axis different from each other and each of the radial axis of the third plurality of connector pads; and a fourth plurality of conductive traces different from the third plurality of conductive traces and configured to connect the fourth plurality of connector pads to the device, wherein each of the fourth plurality of conductive traces has a fourth length equal to the third length.

Other features and advantages associated with the apparatus and methods disclosed herein will be apparent to those skilled in the art based on the accompanying drawings and detailed description.

BRIEF DESCRIPTION OF THE DRAWINGS

A more complete appreciation of aspects of the disclosure and many of the attendant advantages thereof will be readily obtained as the same becomes better understood by reference to the following detailed description when considered in connection with the accompanying drawings which are presented solely for illustration and not limitation of the disclosure, and in which.

Figure 1:
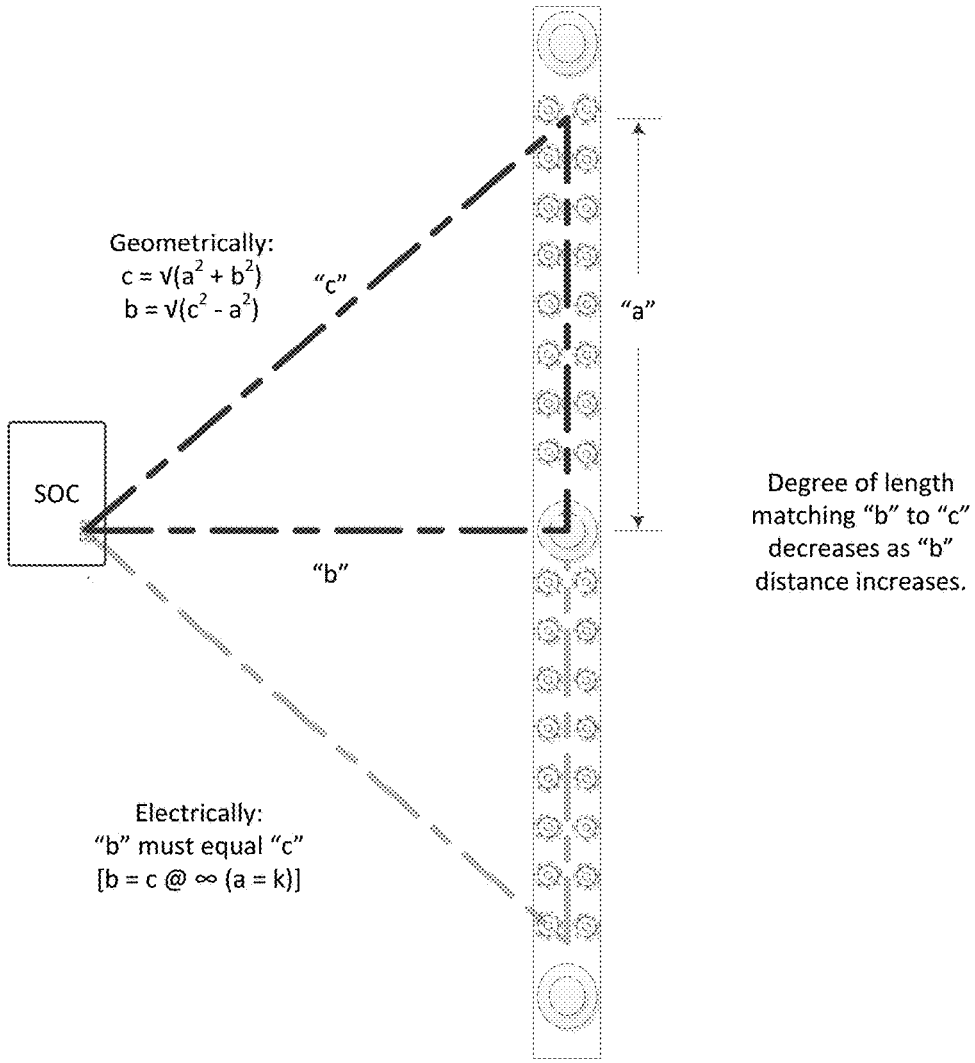
FIG. 1 illustrates a top down view of an exemplary prior art right triangle trace geometry.

In accordance with common practice, the features depicted by the drawings may not be drawn to scale. Accordingly, the dimensions of the depicted features may be arbitrarily expanded or reduced for clarity. In accordance with common practice, some of the drawings are simplified for clarity. Thus, the drawings may not depict all components of a particular apparatus or method. Further, like reference numerals denote like features throughout the specification and figures.

DETAILED DESCRIPTION

Figure 2:
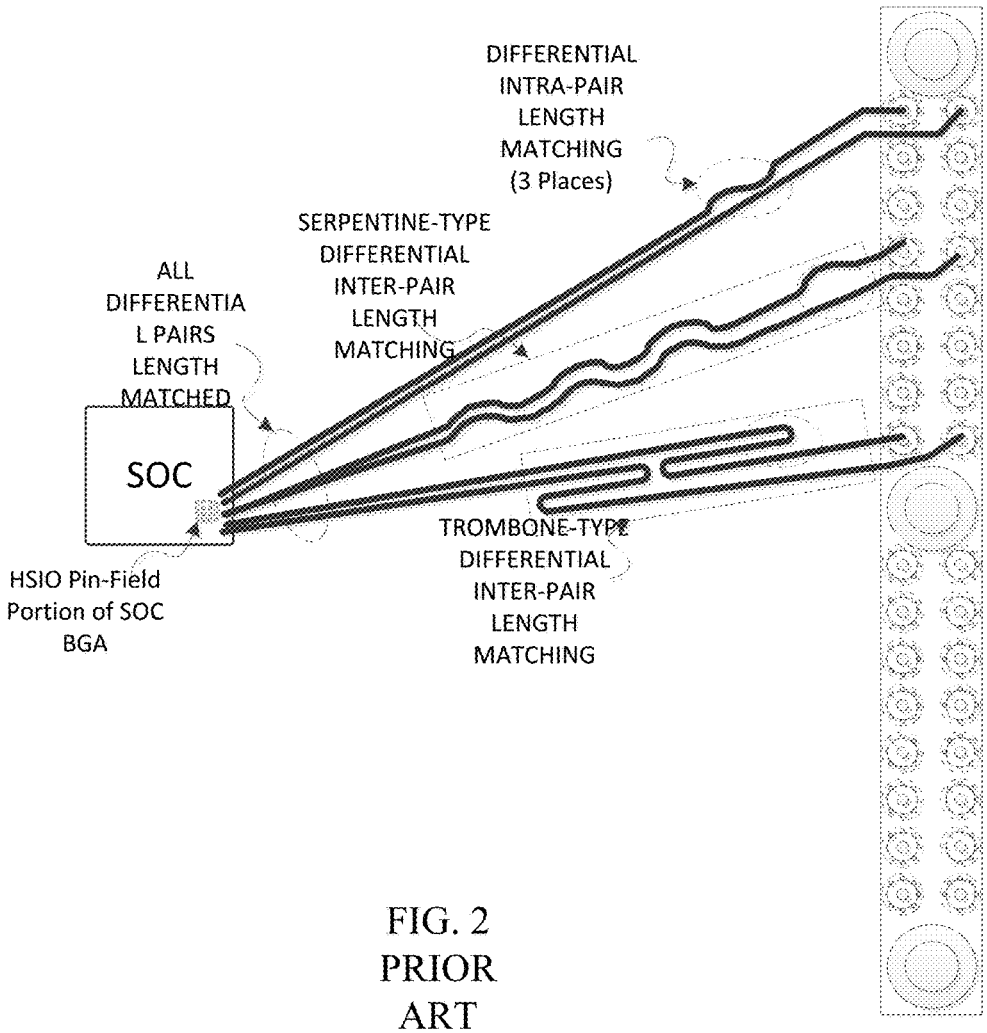
FIG. 2 illustrates a top down view of an exemplary prior art traditional right-angle linear connector trace length matching techniques.

The exemplary methods, apparatus, and systems disclosed herein mitigate shortcomings of the conventional methods, apparatus, and systems, as well as other previously unidentified needs. In one example, In contrast to the traditional rectangular multi-signal linear connector (See FIGS. 1 and 2), a radial quarter-round shaped multi-signal connector may allow for a trace length that is much easier to maintain the minimal routing requirements due to a near constant radius of the connector. The radial quarter-round shaped connector may allow the trace layout artist much more freedom on placement, while maintaining solid signal integrity, signal symmetry, and a short reach, with no or minimal serpentine traces. Other examples include horizontal mounted stacked radial connectors, and horizontal edge mounted stacked radial connectors. For instance, very high pin count HSIOs could be accommodated with two connectors, if the pins are contained within the same area of the BGA. Other examples of the radial connector may include a radial quarter-round shaped multi-signal connector with a single row, vertical mounted radial connector, horizontal mounted stacked radial connectors, and horizontal edge mounted stacked radial connectors.

Figure 3:
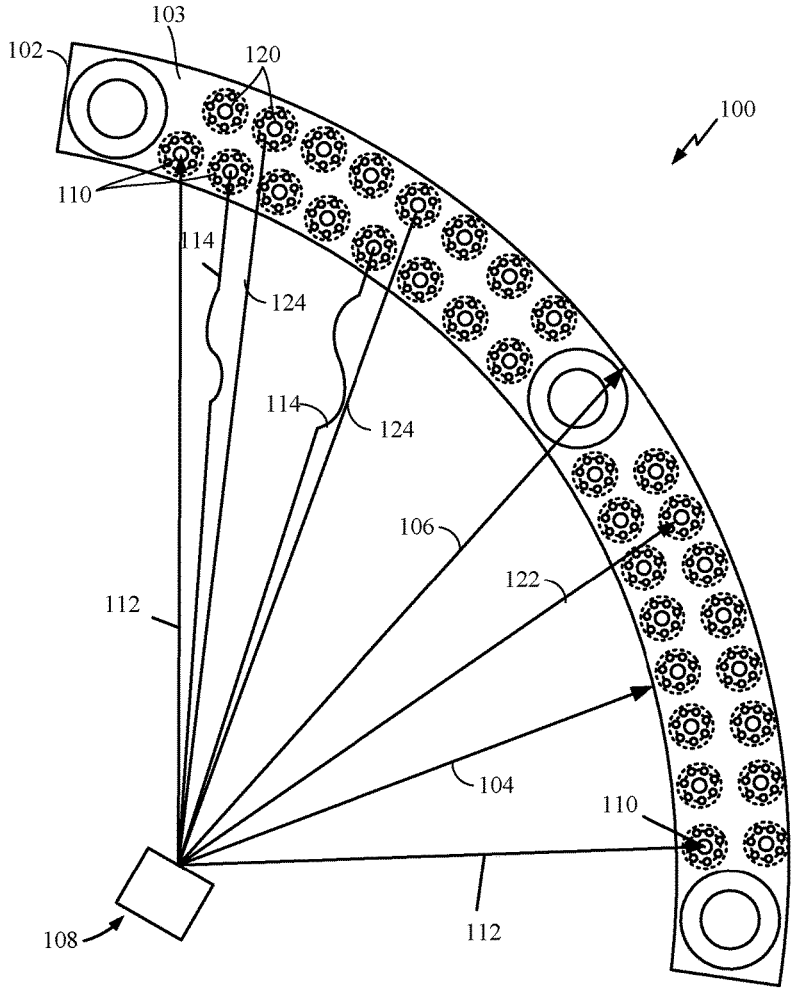
FIG. 3 illustrates a top down view of an exemplary connector with a double row of right-angle connector pads in accordance with some examples of the disclosure.

FIG. 3 illustrates a top down view of an exemplary connector with a double row of right-angle connector pads in accordance with some examples of the disclosure. As shown in FIG. 3, a cable connector 100 may include a connector body 102 with a first surface 103 parallel to a device 108 (e.g. a SoC or other electrical device with input output pins). The connector body 102 may have a radial quarter-round shape with an inner radius 104 and an outer radius 106 longer than the inner radius 104. The cable connector 100 may include a first plurality of connector pads 110 on the first surface 103 perpendicular (i.e. at a right-angle to the plane of the device 108) to the device 108 with each of the first plurality of connector pads 110 at a first radius 112 longer than the inner radius 104 and a different radial axis from each other. The cable connector 100 may include a first plurality of conductive traces 114 (e.g. cable connectors or copper traces) configured to connect a respective one of the first plurality of connector pads 110 to the device 108. While only a couple conductive traces 114 are shown, it should be understood that more or less may be used depending on the number of signal pairs desired. The cable connector 100 may include a second plurality of connector pads 120 on the first surface 103 away from the device 108 with each of the second plurality of connector pads 120 at a second radius 122 longer than the inner radius 112 and a different radial axis from each other. The cable connector 100 may include a second plurality of conductive traces 124 (e.g. cable connectors or copper traces) configured to connect a respective one of the second plurality of connector pads 120 to the device 108. While only a couple conductive traces 124 are shown, it should be understood that more or less may be used depending on the number of signal pairs desired.

Each of the first plurality of conductive traces 114 has a first length and each of the second plurality of conductive traces 124 has a second length that must be equal to the first length. This allows a differential signal pair with signal symmetry between the pair of signal traces to be configured between a conductive trace 114 and a conductive trace 124 with each trace of the differential signal pair having the same length. Since the first radius 112 is shorter than the second radius 122, the conductive traces 114 may be laid out in a slightly meandering line between the connector pad 110 it is connected to and the device 108 while the conductive traces 124 may be laid out in a straight line between the connector pad 120 it is connected to and the device 108. One benefit of the radial shaped connector body 102 is that any one connector pad 110 and any one connector pad 120 may be used to configure a differential signal pair unlike a conventional straight linear connector that requires adjacent connector pads to be used for the differential pairs otherwise the difference in length of the traces would require a large amount of tromboning and/or serpentining.

Figure 4:
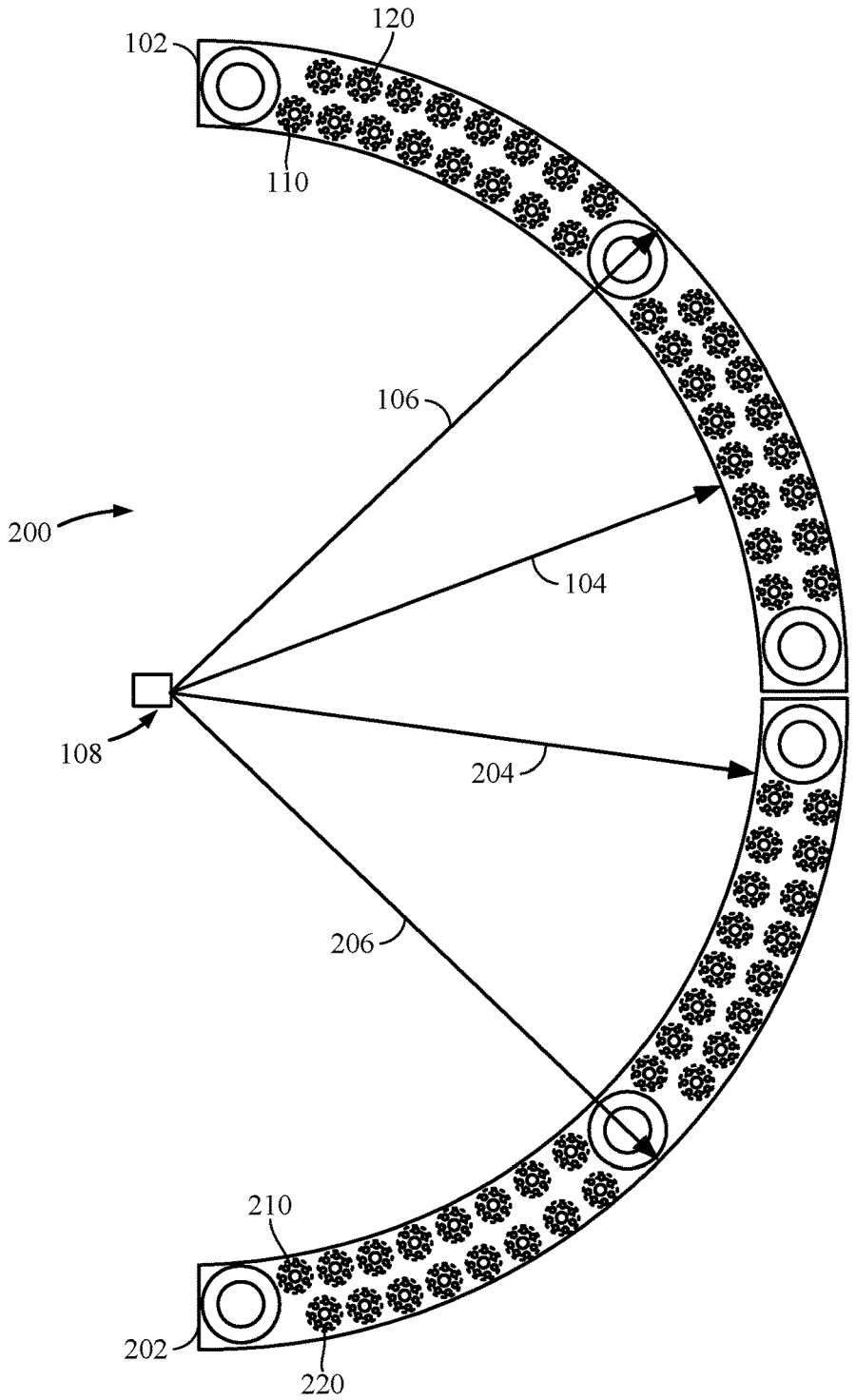
FIG. 4 illustrates a top down view of an exemplary connector with double connector bodies in accordance with some examples of the disclosure.

FIG. 4 illustrates a top down view of an exemplary connector with double connector bodies in accordance with some examples of the disclosure. As shown in FIG. 4, a cable connector 200 may include a first connector body 102 spaced from a device 108 with an inner radius 104 and an outer radius 106 longer than the inner radius 104. The first connector body 102 may include a first plurality of connector pads 110 and a second plurality of connector pads 120. The cable connector 200 may include a second connector body 202 spaced from the device 108 with an inner radius 204 and an outer radius 206 longer than the inner radius 204. The second connector body 202 may include a third plurality of connector pads 210 and a fourth plurality of connector pads 220. When the inner radius 104 and 204 are the same and the outer radius 106 and 206 are the same, a differential signal pair with signal symmetry may be configured between any pair of connector pads 110 and 120, pads 110 and 220, pads 210 and 220, or pads 210 and 120. This may provide a benefit over a conventional straight linear connector or two that require adjacent connector pads to be used for the differential pairs otherwise the difference in length of the traces would require an excessive amount of tromboning and/or serpentining.

Figure 5:
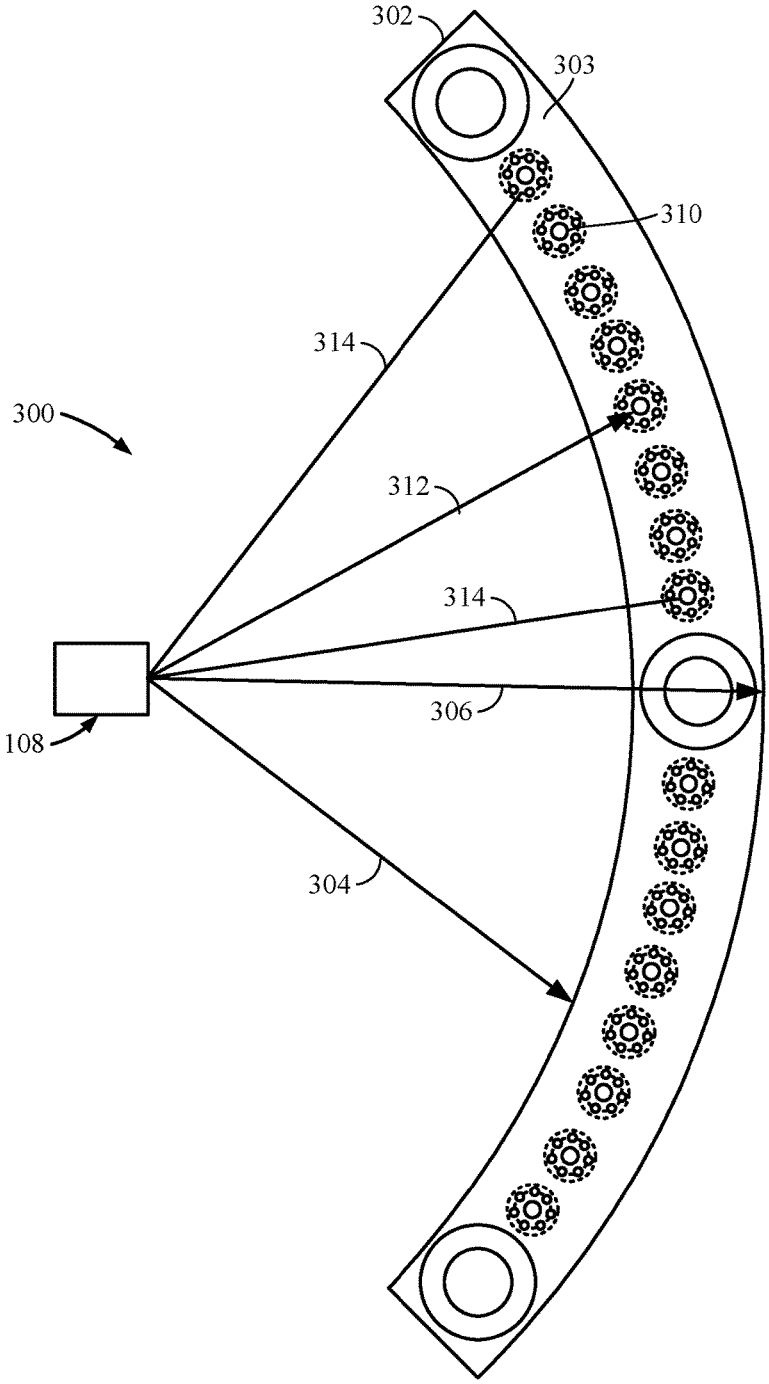
FIG. 5 illustrates a top down view of an exemplary connector with a single row of right-angle connector pads in accordance with some examples of the disclosure.

FIG. 5 illustrates a top down view of an exemplary connector with a single row of right-angle connector pads in accordance with some examples of the disclosure. As shown in FIG. 5, a cable connector 300 may include a connector body 302 with a first surface 303 parallel to a device 108. The connector body 302 may have a radial quarter-round shape with an inner radius 304 and an outer radius 306 longer than the inner radius 304. The cable connector 300 may include a first plurality of connector pads 310 on the first surface 303 with each of the first plurality of connector pads 310 at a first radius 312 longer than the inner radius 304 and a different radial axis from each other. The cable connector 300 may include a first plurality of conductive traces 314 (e.g. cable connectors or copper traces) configured to connect a respective one of the first plurality of connector pads 310 to the device 108. While only a couple conductive traces 314 are shown, it should be understood that more or less may be used depending on the number of signal pairs desired. Each of the first plurality of conductive traces 314 has a first length. This allows a differential signal pair with signal symmetry between the pair of signal traces to be configured between any two conductive traces 314 with each trace of the differential signal pair having the same length. One benefit of the radial shaped connector body 302 is that any one connector pad 312 and any other connector pad 312 may be used to configure a differential signal pair unlike a conventional straight linear connector that requires adjacent connector pads to be used for the differential pairs otherwise the difference in length of the traces would require a large amount of tromboning and/or serpentining.

Figure 6A:
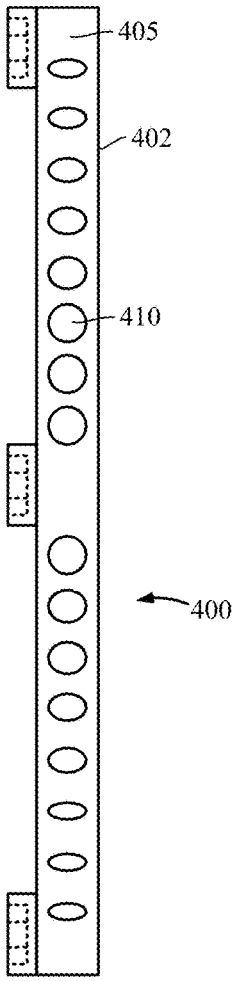
FIGS. 6A and B illustrate a side view and a top down view, respectively, of an exemplary connector with co-planar connector pads extending away from the device in accordance with some examples of the disclosure.
Figure 6B:
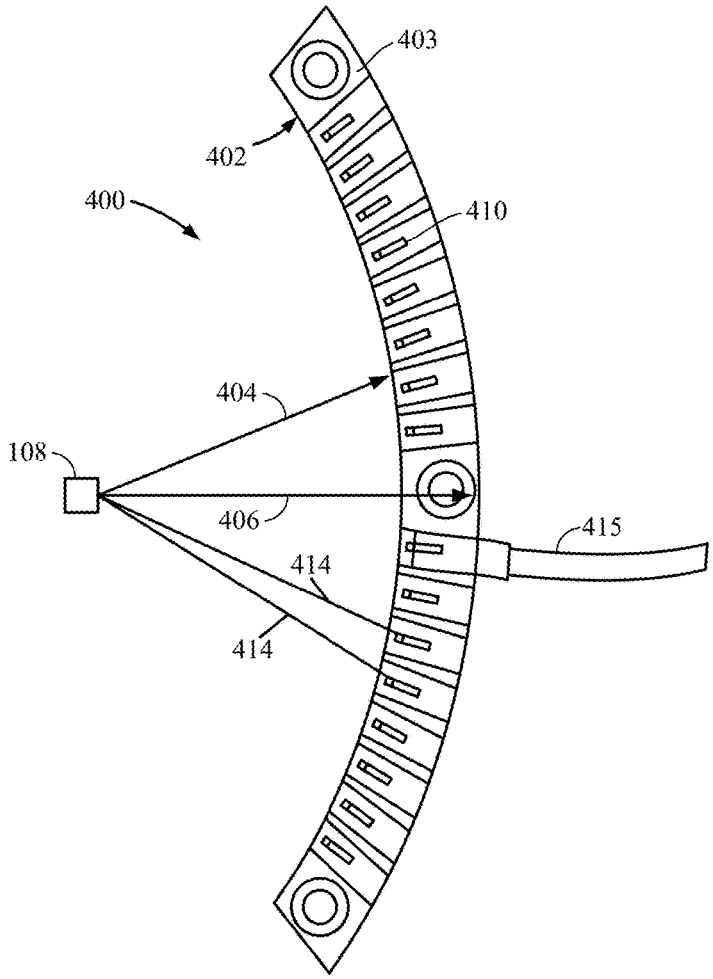

FIGS. 6A and B illustrate a side view and a top down view, respectively, of an exemplary connector with co-planar connector pads extending away from the device in accordance with some examples of the disclosure. As shown in FIG. 6A, a cable connector 400 may include a connector body 402 with a second surface 405 on an edge of the cable connector 400 and a first plurality of connectors 410 extending through the connector body 402. As shown in FIG. 6B, the connector body 402 may be a radial quarter-round shape with an inner radius 404 and an outer radius 406 longer than the inner radius 404. The cable connector 400 may include a first plurality of connectors 410 under a first surface 403 with each of the first plurality of connector 410 on a different radial axis from each other. A cable 415 (e.g. a coaxial cable connector) may be connected to at least one of the first plurality of connectors 410 on the second surface 405 and a plurality of conductive traces 414 (e.g. traces 114) on an opposite surface from 405 may be configured to connect a respective one of the first plurality of connectors 410 to the device 108. The cable 415 may connect to another device or connection such as a chassis to allow the device 108 to be connected through the cable connector 400 to the other device or chassis. Each of the first plurality of conductive traces 414 has a first length. This allows a differential signal pair with signal symmetry between the pair of signal traces to be configured between any two conductive traces 414 with each trace of the differential signal pair having the same length. One benefit of the radial shaped connector body 402 is that any one connector 410 and any other connector 410 may be used to configure a differential signal pair unlike a conventional straight linear connector that requires adjacent connector pads to be used for the differential pairs otherwise the difference in length of the traces would require a large amount of tromboning and/or serpentining.

Figure 7A:
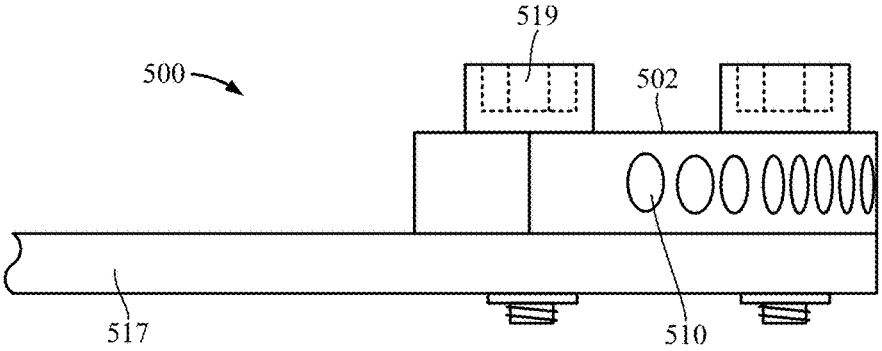
FIGS. 7A and B illustrate side views of an exemplary connector with single row co-planar connector pads and a double connector arrangement of the same in accordance with some examples of the disclosure.
Figure 7B:
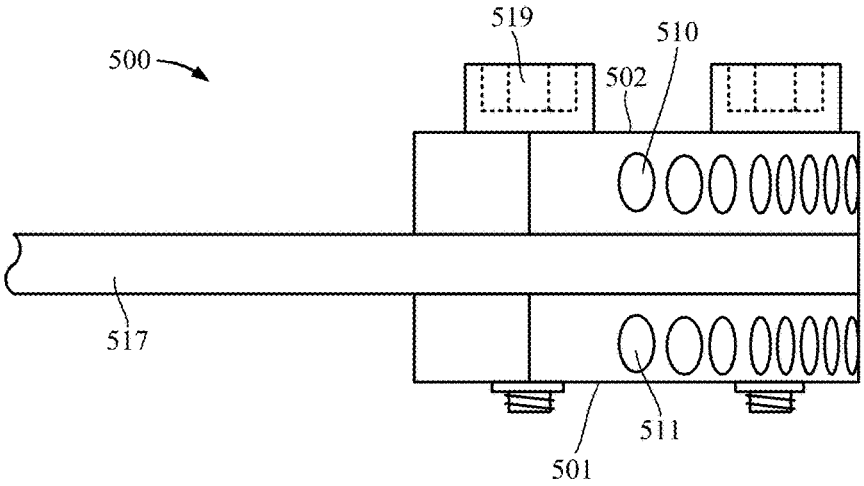

FIGS. 7A and B illustrate side views of an exemplary connector with single row co-planar connector pads and a double connector arrangement of the same in accordance with some examples of the disclosure. As shown in FIG. 7A, a cable connector 500 (e.g. cable connector 400) may include a connector body 502 with a first plurality of connectors 510 extending through the connector body 502. The connector body 502 may be attached to a printed circuit board (PCB) 517 with at least one fastener (e.g. a screw) 519 or other suitable means. As shown in FIG. 7B, the cable connector 500 may include a first connector body 502 with a first plurality of connectors 510 and a second connector body 501 with a second plurality of connectors 511. The first connector body 502 may be attached to a PCB 517 with at least one fastener 519 or other suitable means and the second connector body 501 may be attached to an opposite side of the PCB 517 with the same fastener 519 or a separate attachment means.

Figure 8A:
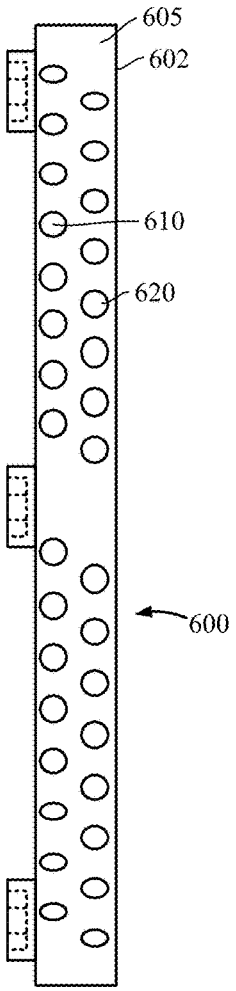
FIGS. 8A and B illustrate a side view and a top down view, respectively, of an exemplary connector with a double row of co-planar connector pads extending away from the device in accordance with some examples of the disclosure.
Figure 8B:
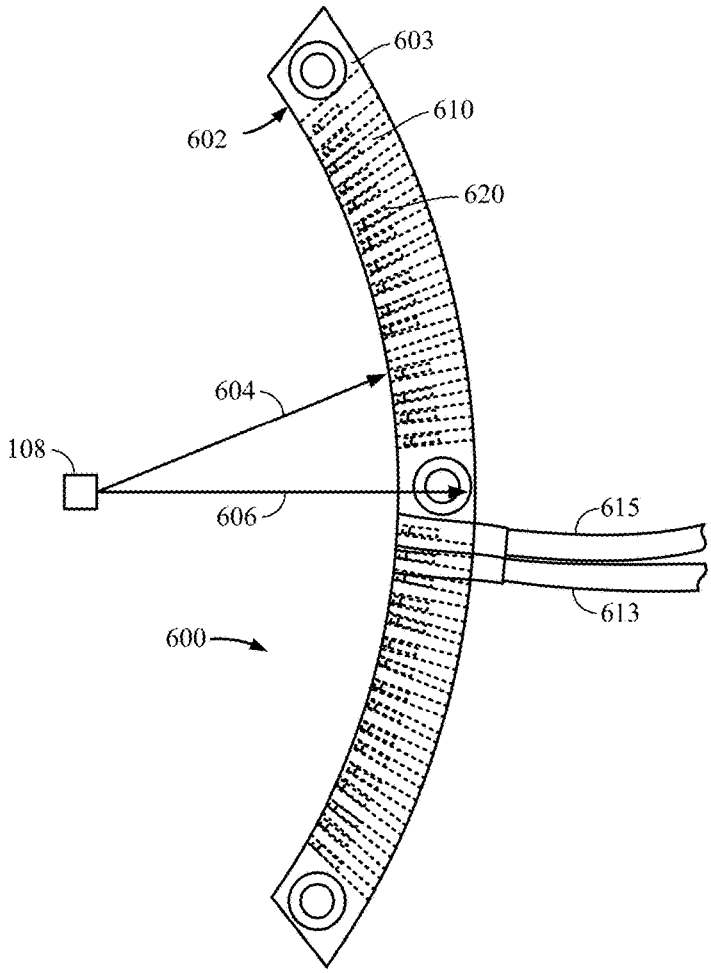

FIGS. 8A and B illustrate a side view and a top down view, respectively, of an exemplary connector with a double row of co-planar connector pads extending away from the device in accordance with some examples of the disclosure. As shown in FIG. 8A, a cable connector 600 (e.g. cable connector 400) may include a connector body 602 with a second surface 605 on an edge of the cable connector 600, a first plurality of connectors 610 extending through the connector body 602, and a second plurality of connectors 620 vertically offset from the first plurality of connectors 610. As shown in FIG. 8B, the connector body 602 may have a radial quarter-round shape with an inner radius 604 and an outer radius 606 longer than the inner radius 604. The cable connector 600 may include a first plurality of connectors 610 under a first surface 603 with each of the first plurality of connector 610 on a different radial axis from each other and a second plurality of connectors 620 under first plurality of connectors 610 and vertically offset to allow for easier routing. A first cable 615 (e.g. a coaxial cable connector) may be connected to at least one of the first plurality of connectors 610 on the second surface 605 and a plurality of traces (e.g. traces 114, not shown) one an opposite surface from 605 may be configured to connect a respective one of the first plurality of connectors 610 to the device 108. A second cable 613 (e.g. a coaxial cable connector) may be connected to at least one of the second plurality of connectors 620 on the second surface 605 and a plurality of traces (e.g. traces 114, not shown) on an opposite surface from 605 may be configured to connect a respective one of the second plurality of connectors 620 to the device 108. This allows a differential signal pair with signal symmetry between the pair of signal traces to be configured between any two connectors 610 and 620 with each trace of the differential signal pair having the same length. One benefit of the radial shaped connector body 602 is that any one connector 610 and any other connector 620 may be used to configure a differential signal pair unlike a conventional straight linear connector that requires adjacent connector pads to be used for the differential pairs otherwise the difference in length of the traces would require a large amount of tromboning and/or serpentining.

Figure 9A:
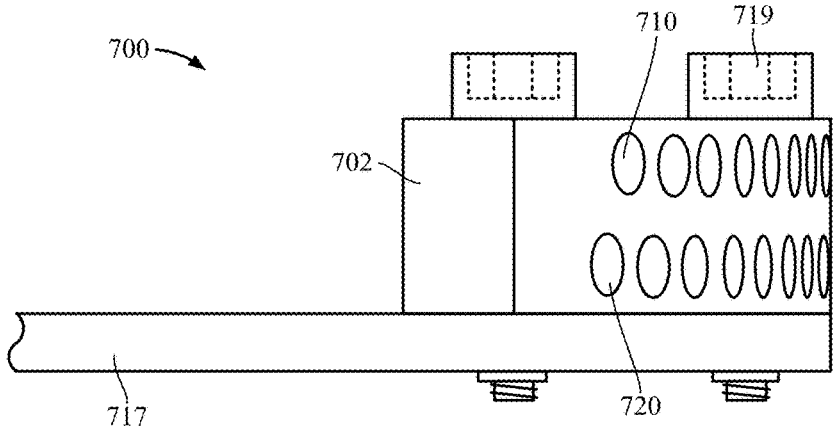
FIGS. 9A and B illustrate side views of an exemplary connector with double co-planar connector bodies in accordance with some examples of the disclosure.
Figure 9B:
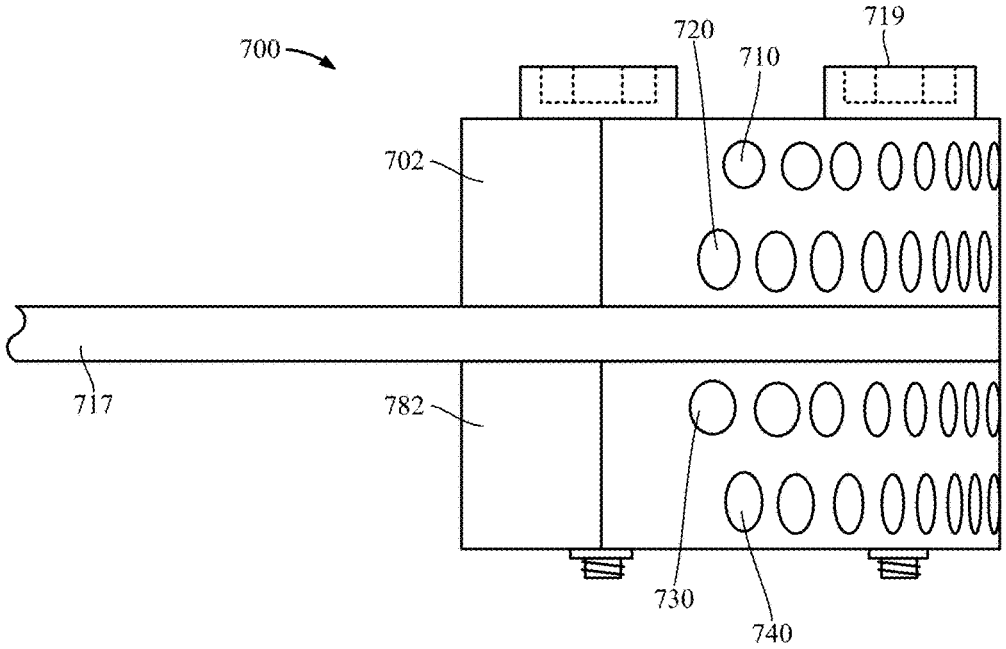

FIGS. 9A and B illustrate side views of an exemplary connector with double co-planar connector bodies in accordance with some examples of the disclosure. As shown in FIG. 9A, a cable connector 700 (e.g. cable connector 400 or 500) may include a first connector body 702 with a first plurality of connectors 710 extending through the first connector body 702 and a second plurality of connectors 720 extending through the first connector body 702. The connector body 702 may be attached to a PCB 717 with at least one fastener (e.g. a screw) 719 or other suitable means. As shown in FIG. 9B, the cable connector 700 may include a first connector body 702 with a first plurality of connectors 710 and a second plurality of connectors 720 on the same side of a PCB 717 as the first connector body 702, a third connector body 782 with a third plurality of connectors 730 and a fourth plurality of connectors 740 on the same side of the PCB 717 as the third connector body 782. The first connector body 702 and the third connector body 782 may be attached to the PCB 717 with at least one fastener 719 or other suitable means.

Figure 10:
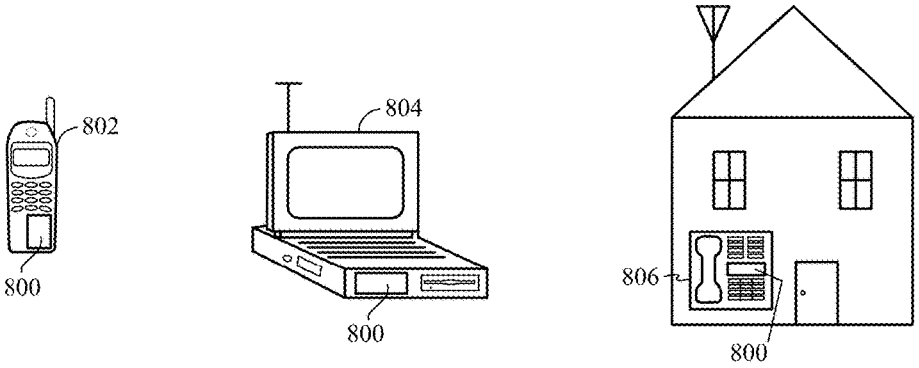
FIG. 10 illustrates various electronic devices that may be integrated with any of the aforementioned integrated device, semiconductor device, integrated circuit, die, interposer, package or package-on-package (PoP) in accordance with some examples of the disclosure.

FIG. 10 illustrates various electronic devices that may be integrated with any of the aforementioned integrated device, semiconductor device, integrated circuit, die, interposer, package or package-on-package (PoP) in accordance with some examples of the disclosure. For example, a mobile phone device 802, a laptop computer device 804, and a fixed location terminal device 806 may include an integrated device 800 as described herein. The integrated device 800 may be, for example, any of the integrated circuits, dies, integrated devices, integrated device packages, integrated circuit devices, device packages, integrated circuit (IC) packages, package-on-package devices described herein. The devices 802, 804, 806 illustrated in FIG. 10 are merely exemplary. Other electronic devices may also feature the integrated device 800 including, but not limited to, a group of devices (e.g., electronic devices) that includes mobile devices, hand-held personal communication systems (PCS) units, portable data units such as personal digital assistants, global positioning system (GPS) enabled devices, navigation devices, set top boxes, music players, video players, entertainment units, fixed location data units such as meter reading equipment, communications devices, smartphones, tablet computers, computers, wearable devices, servers, routers, electronic devices implemented in automotive vehicles (e.g., autonomous vehicles), or any other device that stores or retrieves data or computer instructions, or any combination thereof.

Several applications for the exemplary radial quarter-round shaped connectors exist. For instance, any high-speed communications interface/link from a tight pitch SoC can be applied to an industrial, aeronautical, automotive and/or military application for superior routing and cabling to redirect the signal. These may include such applications as opto-electrical, distributed high-speed processing, electrical test, evaluation boards, IOT (Internet of Things), robotics, and drones. For opto-electrical: as opposed with a straight electrical contact, the holes in the quarter-round shaped connector can support opto-electrical couplers. For electrical test: electrical cables have better signal integrity than signals routed the same distance on the PCB. PCBs have much higher losses. For evaluation boards: evaluation boards are sent to customers to "play" with the evaluation hardware/software platform. By placing a quarter-round shaped connector on these boards, it may ensure that the customer would have good signal integrity to tap into these high-speed signals or to cable them to a board that they own. For distributed high-speed processing: routing high-speed signals from one board to others via cables. For IOT: PCB space is tight on IoT devices due to their small size. They usually have a mobile processor with low pitch geometries. Here it is critical to provide routing room while maintaining signal symmetries. For robotics: robots tend to be made of several PCBs that need to communicate with one another. This is a great solution for the high-speed communications path. For drones: drones are flying robots that also require distributed high-speed communications paths such as control and camera.

In this description, certain terminology is used to describe certain features. The term "mobile device" can describe, and is not limited to, a music player, a video player, an entertainment unit, a navigation device, a communications device, a mobile device, a mobile phone, a smartphone, a personal digital assistant, a fixed location terminal, a tablet computer, a computer, a wearable device, a laptop computer, a server, an automotive device in an automotive vehicle, and/or other types of portable electronic devices typically carried by a person and/or having communication capabilities (e.g., wireless, cellular, infrared, short-range radio, etc.).

Further, the terms "user equipment" (UE), "mobile terminal," "mobile device," and "wireless device," can be interchangeable.

One or more of the components, processes, features, and/or functions illustrated in FIGS. 3-10 may be rearranged and/or combined into a single component, process, feature or function or incorporated in several components, processes, or functions. Additional elements, components, processes, and/or functions may also be added without departing from the disclosure. It should also be noted that FIGS. 3-10 and its corresponding description in the present disclosure is not limited to dies and/or ICs. In some implementations, FIGS. 3-10 and its corresponding description may be used to manufacture, create, provide, and/or produce integrated devices. In some implementations, a device may include a die, an integrated device, a die package, an integrated circuit (IC), a device package, an integrated circuit (IC) package, a wafer, a semiconductor device, a package on package (PoP) device, and/or an interposer.

The wireless communication between electronic devices can be based on different technologies, such as code division multiple access (CDMA), W-CDMA, time division multiple access (TDMA), frequency division multiple access (FDMA), Orthogonal Frequency Division Multiplexing (OFDM), Global System for Mobile Communications (GSM), 3GPP Long Term Evolution (LTE) or other protocols that may be used in a wireless communications network or a data communications network.

The word "exemplary" is used herein to mean "serving as an example, instance, or illustration." Any details described herein as "exemplary" is not to be construed as advantageous over other examples. Likewise, the term "examples" does not mean that all examples include the discussed feature, advantage or mode of operation. Furthermore, a particular feature and/or structure can be combined with one or more other features and/or structures. Moreover, at least a portion of the apparatus described hereby can be configured to perform at least a portion of a method described hereby.

The terminology used herein is for the purpose of describing particular examples and is not intended to be limiting of examples of the disclosure. As used herein, the singular forms "a," "an," and "the" are intended to include the plural forms as well, unless the context clearly indicates otherwise. It will be further understood that the terms "comprises", "comprising," "includes," and/or "including," when used herein, specify the presence of stated features, integers, actions, operations, elements, and/or components, but do not preclude the presence or addition of one or more other features, integers, actions, operations, elements, components, and/or groups thereof.

It should be noted that the terms "connected," "coupled," or any variant thereof, mean any connection or coupling, either direct or indirect, between elements, and can encompass a presence of an intermediate element between two elements that are "connected" or "coupled" together via the intermediate element.

Any reference herein to an element using a designation such as "first," "second," and so forth does not limit the quantity and/or order of those elements. Rather, these designations are used as a convenient method of distinguishing between two or more elements and/or instances of an element. Also, unless stated otherwise, a set of elements can comprise one or more elements.

Nothing stated or illustrated depicted in this application is intended to dedicate any component, action, feature, benefit, advantage, or equivalent to the public, regardless of whether the component, action, feature, benefit, advantage, or the equivalent is recited in the claims.

In the detailed description above it can be seen that different features are grouped together in examples. This manner of disclosure should not be understood as an intention that the claimed examples have more features than are explicitly mentioned in the respective claim. Rather, the situation is such that inventive content may reside in fewer than all features of an individual example disclosed. Therefore, the following claims should hereby be deemed to be incorporated in the description, wherein each claim by itself can stand as a separate example. Although each claim by itself can stand as a separate example, it should be noted that-although a dependent claim can refer in the claims to a specific combination with one or a plurality of claims-other examples can also encompass or include a combination of said dependent claim with the subject matter of any other dependent claim or a combination of any feature with other dependent and independent claims. Such combinations are proposed herein, unless it is explicitly expressed that a specific combination is not intended. Furthermore, it is also intended that features of a claim can be included in any other independent claim, even if said claim is not directly dependent on the independent claim.

It should furthermore be noted that methods, systems, and apparatus disclosed in the description or in the claims can be implemented by a device comprising means for performing the respective actions of this method.

Furthermore, in some examples, an individual action can be subdivided into a plurality of sub-actions or contain a plurality of sub-actions. Such sub-actions can be contained in the disclosure of the individual action and be part of the disclosure of the individual action.

While the foregoing disclosure shows illustrative examples of the disclosure, it should be noted that various changes and modifications could be made herein without departing from the scope of the disclosure as defined by the appended claims. The functions and/or actions of the method claims in accordance with the examples of the disclosure described herein need not be performed in any particular order. Additionally, well-known elements will not be described in detail or may be omitted so as to not obscure the relevant details of the aspects and examples disclosed herein. Furthermore, although elements of the disclosure may be described or claimed in the singular, the plural is contemplated unless limitation to the singular is explicitly stated.

What is claimed is:

1. A cable connector comprising:

a connector body with an inner radius and an outer radius longer than the inner radius;

a plurality of connector pads disposed at a first radius, each of the plurality of connector pads disposed along a radial axis different from each other;

a plurality of conductive traces configured to connect the plurality of connector pads to a device, wherein each of the plurality of conductive traces has substantially a first length; and wherein a first signal on one of the plurality of conductive traces has a signal symmetry with a second signal on a different one of the plurality of conductive traces.

2. The cable connector of claim 1, wherein a first one of the plurality of connector pads and a second one of the plurality of connector pads are connected to differential signal pair pins.

3. The cable connector of claim 1, wherein the cable connector is formed in an arch of at least a portion of circle.

4. The cable connector of claim 1, wherein the plurality of connector pads are located on a first surface of the connector body at a right-angle to the device.

5. The cable connector of claim 1, wherein the cable connector is incorporated into a device selected from a group consisting of a drone, a music player, a video player, an entertainment unit, a navigation device, a communications device, a mobile device, a mobile phone, a smartphone, a personal digital assistant, a fixed location terminal, a tablet computer, a computer, a wearable device, a laptop computer, a server, and a device in an automotive vehicle, and further including the device.

6. A cable connector comprising:

a connector body with an inner radius and an outer radius longer than the inner radius;

a first plurality of connector pads disposed at a first radius on the connector body, each of the first plurality of connector pads disposed along a radial axis different from each other;

a first plurality of conductive traces configured to connect the first plurality of connector pads to a device, wherein each of the first plurality of conductive traces has substantially a first length;

a second plurality of connector pads disposed at a second radius greater than the first radius on the connector body, each of the second plurality of connector pads disposed along a radial axis different from each other and each of the radial axis of the first plurality of connector pads; and a second plurality of conductive traces different from the first plurality of conductive traces and configured to connect the second plurality of connector pads to the device, wherein each of the second plurality of conductive traces has a second length equal to the first length.

7. The cable connector of claim 6, wherein a first signal on one of the first plurality of conductive traces has a signal symmetry with a second signal on one of the second plurality of conductive traces.

8. The cable connector of claim 6, wherein the first plurality of connector pads and the second plurality of connector pads are connected to a plurality of differential signal pair pins.

9. The cable connector of claim 6, wherein the cable connector is formed in an arch of at least a portion of circle.

10. The cable connector of claim 6, wherein each of the first plurality of conductive traces are serpentined.

11. The cable connector of claim 6, wherein each of the second plurality of conductive traces follows a straight line to a respective one of the second plurality of connector pads and each of the first plurality of conductive traces meanders to a respective one of the first plurality of connector pads such that the first length is substantial equal to the second length.

12. The cable connector of claim 6, wherein the first plurality of connector pads and the second plurality of connector pads are located on a first surface of the connector body at a right-angle to the device.

13. The cable connector of claim 6, wherein the cable connector is incorporated into a device selected from a group consisting of a drone, a music player, a video player, an entertainment unit, a navigation device, a communications device, a mobile device, a mobile phone, a smartphone, a personal digital assistant, a fixed location terminal, a tablet computer, a computer, a wearable device, a laptop computer, a server, and a device in an automotive vehicle, and further including the device.

14. A cable connector comprising:

a first connector body with an inner radius, an outer radius longer than the inner radius, a first surface, and a second surface opposite the first surface;

a first plurality of connector pads disposed at a first radius on the first surface of the first connector body, each of the first plurality of connector pads disposed along a radial axis different from each other;

a first plurality of conductive traces configured to connect the first plurality of connector pads to a device, wherein each of the first plurality of conductive traces has substantially a first length;

a second plurality of connector pads disposed at a second radius greater than the first radius on the first surface of the first connector body, each of the second plurality of connector pads disposed along a radial axis different from each other and each of the radial axis of the first plurality of connector pads;

a second plurality of conductive traces different from the first plurality of conductive traces and configured to connect the second plurality of connector pads to the device, wherein each of the second plurality of conductive traces has a second length equal to the first length;

a second connector body with an inner radius, an outer radius longer than the inner radius, a first surface, and a second surface opposite the first surface;

a third plurality of connector pads disposed at a first radius on the second surface of the second connector body, each of the third plurality of connector pads disposed along a radial axis different from each other;

a third plurality of conductive traces configured to connect the third plurality of connector pads to the device, wherein each of the third plurality of conductive traces has substantially a third length;

a fourth plurality of connector pads disposed at the second radius greater than the first radius on the second surface of the second connector body, each of the fourth plurality of connector pads disposed along a radial axis different from each other and each of the radial axis of the third plurality of connector pads; and a fourth plurality of conductive traces different from the third plurality of conductive traces and configured to connect the fourth plurality of connector pads to the device, wherein each of the fourth plurality of conductive traces has a fourth length equal to the third length.

15. The cable connector of claim 14, wherein a first signal on one of the first plurality of conductive traces has a signal symmetry with a second signal on one of the second plurality of conductive traces.

16. The cable connector of claim 14, wherein the first plurality of connector pads and the second plurality of connector pads are connected to a plurality of differential signal pair pins.

17. The cable connector of claim 14, wherein the cable connector is formed in an arch of at least a portion of circle.

18. The cable connector of claim 14, wherein each of the first plurality of conductive traces are serpentined.

19. The cable connector of claim 14, wherein each of the second plurality of conductive traces follows a straight line to a respective one of the second plurality of connector pads and each of the first plurality of conductive traces meanders to a respective one of the first plurality of connector pads such that the first length is substantial equal to the second length.

20. The cable connector of claim 14, further comprising a printed circuit board, wherein the second surface of the first connector body is attached to a first side of the printed circuit board and the first surface of the second connector body is attached to a second side of the printed circuit board opposite the first side of the printed circuit board.

21. The cable connector of claim 14, wherein the cable connector is incorporated into a device selected from a group consisting of a drone, a music player, a video player, an entertainment unit, a navigation device, a communications device, a mobile device, a mobile phone, a smartphone, a personal digital assistant, a fixed location terminal, a tablet computer, a computer, a wearable device, a laptop computer, a server, and a device in an automotive vehicle, and further including the device.

22. A cable connector comprising:

a first connector body with an inner radius and an outer radius longer than the inner radius, an inner surface, and an outer surface opposite the inner surface;

a first plurality of connector pads disposed in the first connector body that extend from the inner surface to the outer surface, each of the first plurality of connector pads disposed along a radial axis different from each other;

a first plurality of conductive traces configured to connect the first plurality of connector pads to a device, wherein each of the first plurality of conductive traces has substantially a first length; and wherein a first signal on one of the first plurality of conductive traces has a signal symmetry with a second signal on a different one of the first plurality of conductive traces.

23. The cable connector of claim 22, wherein a first one of the first plurality of connector pads and a second one of the first plurality of connector pads are connected to differential signal pair pins.

24. The cable connector of claim 22, wherein the cable connector is formed in an arch of at least a portion of circle.

25. The cable connector of claim 22, wherein each of the first plurality of connector pads has an opening located on the outer surface of the first connector body facing away from the device and co-planar with the first plurality of conductive traces.

26. The cable connector of claim 22, further comprising:

a second connector body with an inner radius and an outer radius longer than the inner radius, an inner surface, and an outer surface opposite the inner surface;

a second plurality of connector pads disposed in the second connector body that extend from the inner surface to the outer surface, each of the second plurality of connector pads disposed along a radial axis different from each other;

a second plurality of conductive traces configured to connect the second plurality of connector pads to the device, wherein each of the second plurality of conductive traces has substantially a second length; and wherein a first signal on one of the second plurality of conductive traces has a signal symmetry with a second signal on a different one of the second plurality of conductive traces.

27. The cable connector of claim 22, wherein the cable connector is incorporated into a device selected from a group consisting of a drone, a music player, a video player, an entertainment unit, a navigation device, a communications device, a mobile device, a mobile phone, a smartphone, a personal digital assistant, a fixed location terminal, a tablet computer, a computer, a wearable device, a laptop computer, a server, and a device in an automotive vehicle, and further including the device.

* * * * *